US006536319B1

(12) United States Patent
Boss

(10) Patent No.: US 6,536,319 B1
(45) Date of Patent: Mar. 25, 2003

(54) CUTTING MACHINE FOR AUTOMATICALLY TRIMMING PRINTED PRODUCTS SUCH AS BROCHURES, MAGAZINES OR BOOKS

(75) Inventor: Heinz Boss, Strengelbach (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 09/265,997

(22) Filed: Mar. 11, 1999

(30) Foreign Application Priority Data

Mar. 11, 1998 (EP) ..... 98810207

(51) Int. Cl.[7] ..... B26D 1/04

(52) U.S. Cl. ..... 83/247; 83/255; 83/269; 83/468.7; 83/934

(58) Field of Search ..... 83/934, 269, 468.6, 83/468.7, 468.2, 213, 255, 352, 403.1, 247, 268

(56) References Cited

U.S. PATENT DOCUMENTS

| | | | | |
|---|---|---|---|---|
| 490,877 A | * | 1/1893 | Lovell et al. | 83/255 X |
| 1,076,726 A | * | 10/1913 | Welch | 83/255 |
| 1,327,915 A | | 1/1920 | Kast | 83/251 |
| 2,017,462 A | * | 10/1935 | Kleineberg | 83/253 |
| 3,146,650 A | * | 9/1964 | Sarring et al. | 83/255 X |
| 3,913,750 A | | 10/1975 | Sarring | 414/796.1 |
| 4,505,173 A | * | 3/1985 | Hartlage | |
| 4,518,157 A | * | 5/1985 | Stobb | |
| 4,922,773 A | | 5/1990 | Ito | 83/76.6 |
| 5,086,681 A | | 2/1992 | Ruetschle et al. | 83/277 |
| 5,467,677 A | * | 11/1995 | Kinson, Jr. | |

FOREIGN PATENT DOCUMENTS

| | | |
|---|---|---|
| CH | 340479 | 10/1959 |
| CH | 531401 | 1/1973 |
| DE | 24 24 325 | 1/1975 |
| GB | 738039 | 10/1955 |
| JP | 09094796 | 4/1997 |

* cited by examiner

*Primary Examiner*—Kenneth E. Peterson
(74) *Attorney, Agent, or Firm*—Venable; Robert Kinberg; Jeffrey Gluck

(57) ABSTRACT

A cutting machine for trimming three sides of printed products includes blades that are moved up and down in a first cutting station for trimming the front, and in a second cutting station for trimming the top and bottom of the printed products. A transport mechanism is provided for positioning the printed products at adjustable rear stops. The conveying path formed between adjustable stops associated with the cutting stations and the cutting region specified for top and bottom trimming along the conveying path of the printed products are variable.

11 Claims, 4 Drawing Sheets

CUTTING MACHINE FOR AUTOMATICALLY TRIMMING PRINTED PRODUCTS SUCH AS BROCHURES, MAGAZINES OR BOOKS

CROSS-REFERENCE TO RELATED APPLICATIONS

Priority is claimed with respect to European Patent Application No. 98810207.5-2302 filed in the European Patent Office on Mar. 11, 1998, the disclosure of which is incorporated herein by reference.

BACKGROUND OF THE INVENTION

The invention relates to a cutting machine for automatically trimming printed products such as brochures, magazines, and catalogues transported spine first to first and second cutting stations spaced from one another in the transport direction. Each station includes at least one clamping bar for clamping the printed product during a trimming operation and at least one blade associated with the clamping bar that is movable up and down for trimming at least one of the front, top, and bottom of the printed products, wherein the blades of the cutting stations are movable together. In such a machine, transport means are provided for transporting the printed products along a conveying path from the first cutting station to the second cutting station, and adjustable stops are associated with the cutting stations and disposed along the conveying path for the printed products.

Cutting machines of this type have long been known, and are used, among other things, for producing brochures, magazines or books following gathering and stapling, or other binding processes.

A known cutting machine produced by Grapha Holding AG, the assignee of the invention disclosed herein, is embodied as a so-called three-side trimmer. At a first cutting station, the front is trimmed transversely to the conveying direction of the printed products, that is, the edge of the open side is trimmed to size. In the second cutting station, the top and bottom of the printed product are cut with two oppositely-located blades. A cut through the center can be made in addition to the top and bottom cuts. In one cutting stroke of the blades, two printed products are trimmed, one at the front and the other at the top and bottom. If there is an additional center cut, it is simpler to trim the front before the top and bottom because of the guides. Each cutting station has stops, and a transport device having upper and lower belts is provided between the cutting stations of the cutting machine.

Similar cutting machines are disclosed in CH-A-340479 and CH-A-531401.

One essential requirement for such cutting machines is the highest-possible production speed or production output. This is especially a function of the format and thickness of a printed product, or the weight of the printed product and the quality of the paper. Thin, stable printed products can be moved at high speeds. Thick, heavy and voluminous printed products must be processed at reduced speeds. The attainable production speeds are strongly influenced by the width of the printed products seen in the transport direction, the distance between the two cutting stations and the length of the conveying path between the stations, respectively. The front edge, or the open side, of the printed products is cut by a blade of a cutting station, the blade being disposed transversely to the transport direction, while, in contrast, the top and bottom edges are simultaneously trimmed by two oppositely-located blades of the next cutting station, the blades being oriented in the transport direction of the printed products.

The respectively more stable binding or spine of a printed product constitutes the reference edge, according to which the front is trimmed with specific spacing. In other words, the printed products are transported, with their spine or binding forward, toward the stops associated with the corresponding cutting station. It must be kept in mind here that the blades specified for trimming the top and bottom must not make an undesired cut in, or otherwise damage, the preceding or following printed product.

SUMMARY OF THE INVENTION

It is an object of the invention to provide a cutting machine of the aforementioned generic type that permits the optimization of the production speed with respect to format.

This object is accomplished in the context of the generic cutting machine first described above, wherein the conveying path of the transport means formed by the spacing between stops associated with the cutting stations, and the cutting region specified for top and bottom trimming along the conveying path of the printed products, are variable.

Consequently, in the cutting machine of the invention, it is possible to alternate between at least two format ranges, and the distance between two cutting stations can be optimally adapted to the current printed-product format.

In contrast to the known cutting machines, in which the cutting stations are spaced at fixed intervals, in the cutting machine of the invention, the distance between the cutting stations can be, for example, reduced, for a given printed product. Such a reduction permits a corresponding increase in the speed of the printed products.

The format adaptation additionally permits an optimization of the delay and acceleration of the printed products between the cutting stations. Difficult-to-process printed products, for example, very thin, sensitive and slick printed products, can be optimally accelerated and delayed. Moreover, the cutting machine offers careful handling of the products.

The invention is explained below with reference to the drawings. All details not discussed at length in the description are to be inferred from the drawings.

DETAILED DESCRIPTION OF THE INVENTION

Figure 1A:
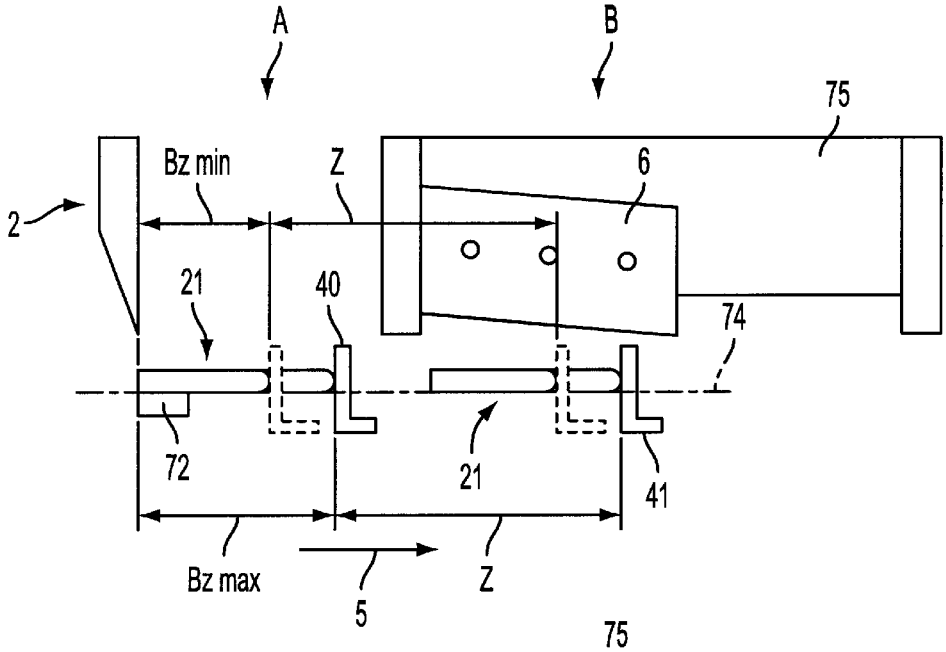
FIGS. 1*a*–1*c* are schematic representations of the cutting machine of the invention for processing printed products having different format-width ranges.
Figure 1B:
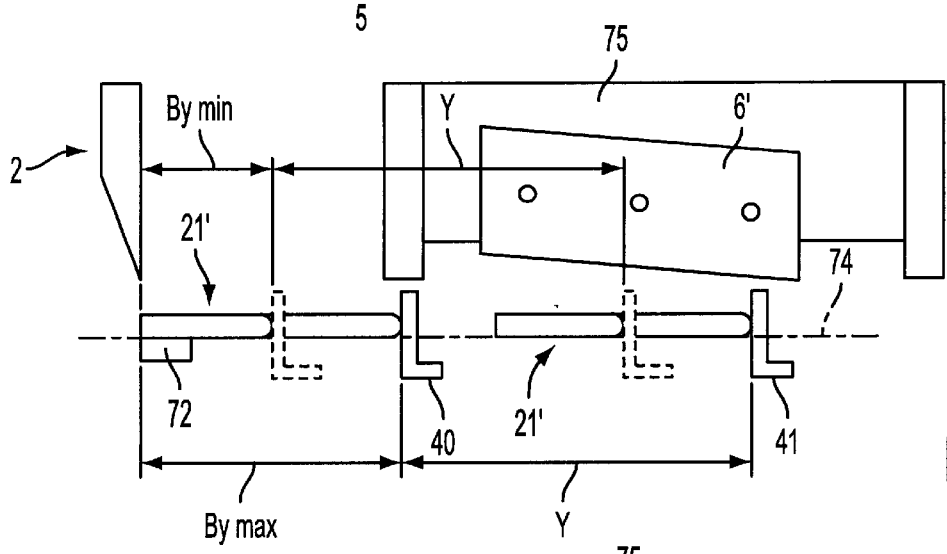
Figure 1C:
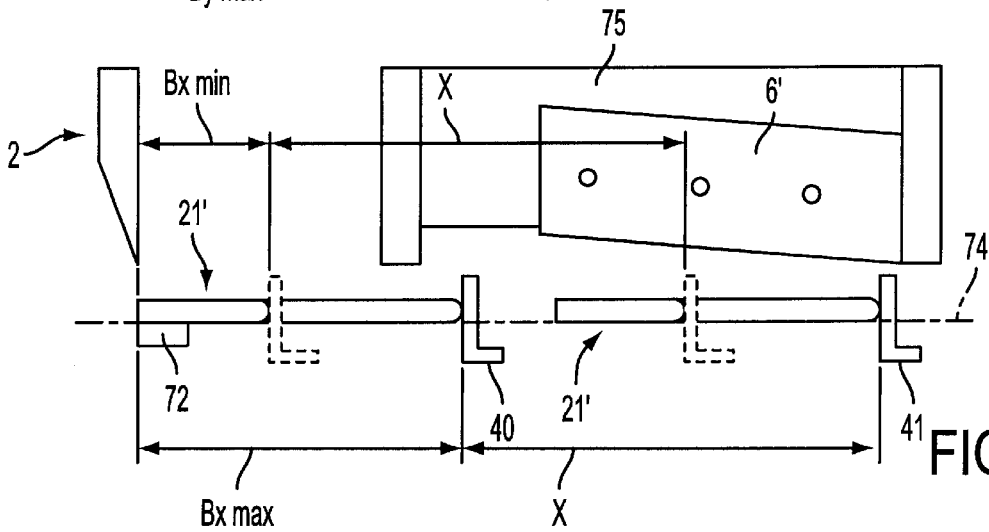

FIGS. 1*a* through 1*c* schematically show a cutting machine 1 having two cutting stations A, B, with station A being provided for trimming the front or open side of a printed product 21 transported binding-first in the arrow direction 5, and station B being provided for trimming the top and bottom.

FIG. 1*a* shows printed products 21 in the format range with the smallest widths Bz min and the widest widths Bz max. The representation indicates a completed front cut at the rear end of a printed product 21 in station A, and a printed product in station B whose top and bottom have been trimmed simultaneously with the trimming of the front cut of the product in station A, and whose front has been trimmed in the cutting station A in a previous trimming operation.

The printed products 21 are supplied cyclically to the cutting stations A, B. In this rhythm, the front is trimmed in the cutting station A by a blade 2, and the top and bottom are trimmed in the cutting station B by oppositely-located blades 6 which move up and down together with blade 2. Rear stops 40, 41 constitute the reference position and orientation of the printed products 21 in the cutting position, and their spacing Z can be adapted to the width of the front-trimmed printed product 21 or an optimum product output.

Furthermore, rear stops 40, 41 are adjustable so that, after the printed products 21 have been trimmed, the stops can be shifted into an inoperative position, for example beneath the conveying plane 74, indicated by a dot-dash line, for the further transport of the printed products by transport means that will be described below. When the edges are trimmed, the printed products 21 are pressed by a clamping bar 3 against a counter-blade 72 in station A shown in FIGS. 1 and 2, or by a clamping bar 38 against a counter-blade 36 in station B shown in FIG. 6. Along the conveying path of the printed products 21, in the cutting region for the top and bottom edges of a printed product 21, a blade carrier 75, with a respective blade 6 being adjustably secured thereto, is disposed on each side of the conveying path in the cutting region for the top and bottom edges of the printed product, spaced from the blade 2 specified for trimming the front edge.

The purpose of blades 6 being adjustable on blade carrier 75 is illustrated by FIG. 1*b*, in which the same process is performed as in FIG. 1*a*, with a longer blade 6', for a printed product 21 of a larger format. A spacing Y between rear stops 40, 41 and the position of blades 6' and their length have been adapted to printed product 21 for optimizing production output. In other words, longer blades 6' are used for trimming the top and bottom, with the blades being displaced in the downstream direction on blade carriers 75 such that two printed products 21 can be trimmed at the same time without impediments.

FIG. 1*c* shows the top and bottom trimming of the widest printed product 21, in which the stops 40, 41 have the largest spacing, i.e., form the largest conveying path. To this end, the longest blade 6' is used in the furthest position on the blade carrier 75.

Figure 2:
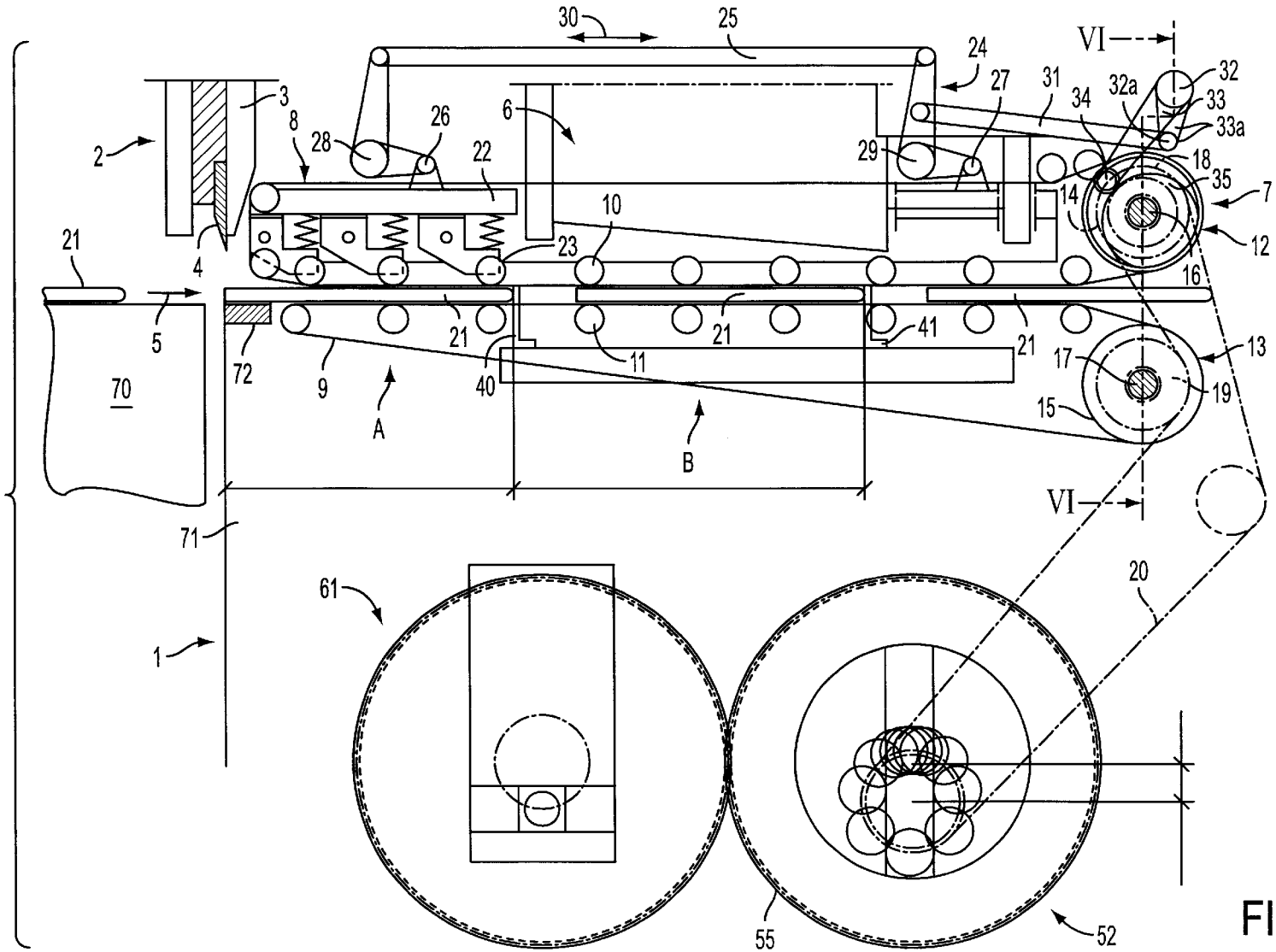
FIG. 2 shows a fragmentary vertical section through a cutting machine of the invention.

FIG. 2 shows a cutting machine 1 that is supplied with printed products 21 in the direction of the arrow 5 by a known gathering-and-stapling machine 70. These printed products 21 are, for example, brochures, catalogues, magazines or other paper products. In cutting machine 1, printed products 21 are supplied to a first cutting station A by a transport device 7. The front of the printed product 21 is trimmed by a blade 2 in first station A. The printed product is subsequently further transported to a second cutting station B by transport device 7. In station B, the top and bottom are trimmed by two blades 6, of which only one is shown. Then printed product 21, being trimmed on three sides, is transported away by transport device 7 for further processing. Transport device 7 has upper belts 8 and lower belts 9 with which printed products 21 are guided individually to rear stops 40 or 41.

Three steps are involved to alter the distance between cutting stations A and B of cutting machine 1. In a first step, correspondingly long blades 6' are installed. Blades 6 and 6' for trimming the top and bottom are thus exchangeable. As an alternative, two blades 6 can be displaced in the transport direction. In a second step, transport direction 7 is changed. This can be effected in a simple manner, for example, by exchanging drive rollers 14 and 15 for the drive belts 8 and 9, respectively, for drive rollers of different sizes (see also FIG. 6). In a third step, rear stops 40 and 41 are displaced to adapt the stop distance.

Figure 3:
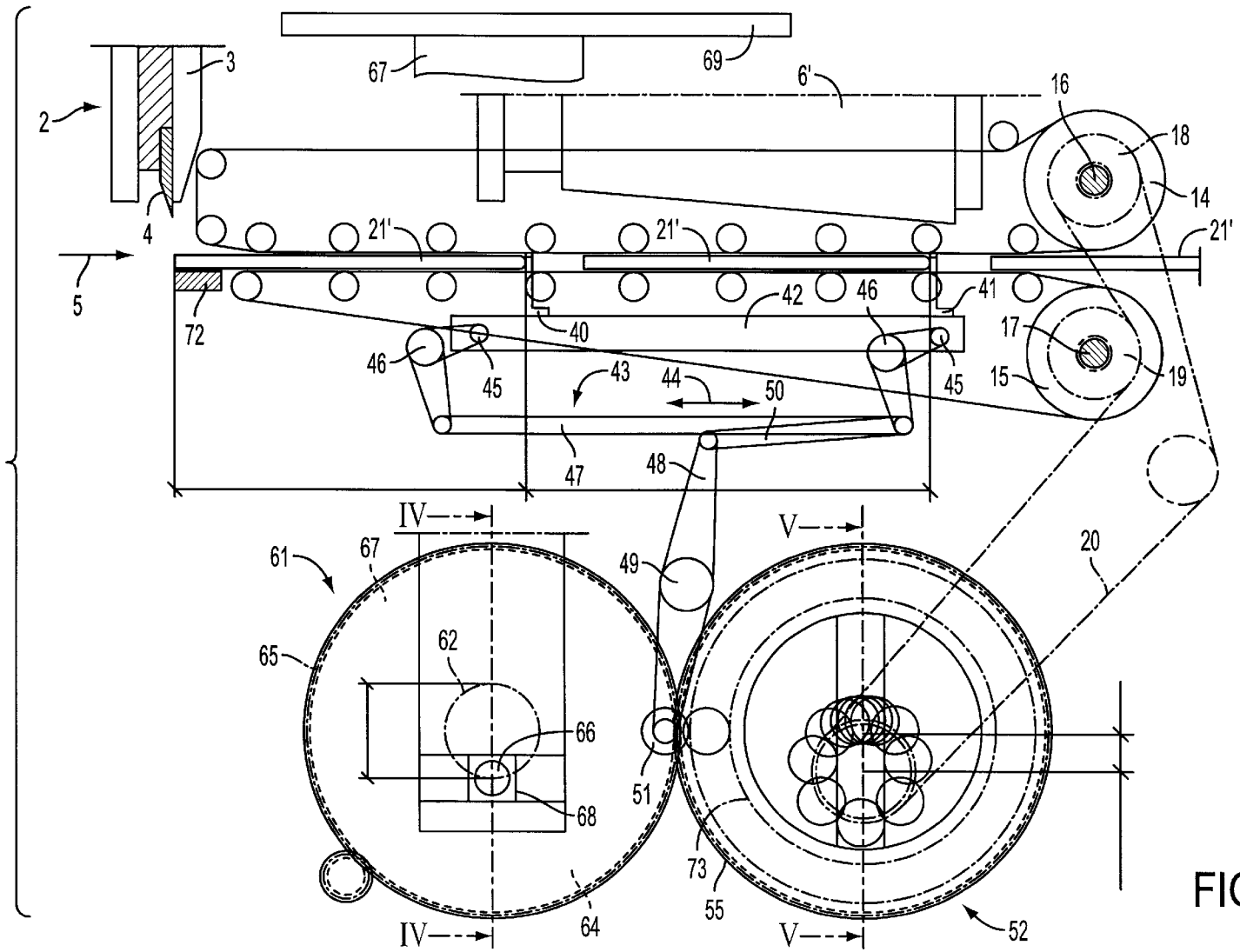
FIG. 3 is a representation in accordance with FIG. 1, but with a different cutting-station spacing.
Figure 4:
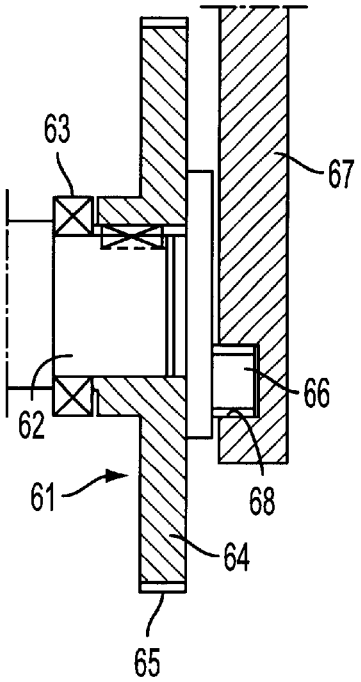
FIG. 4 shows a section along the line IV—IV in FIG. 3.

Blades 2 and 6 are movable together up and down with a constant stroke. FIG. 3 shows schematically blades 2 and 6' mounted to a yoke 69 and connected to a crank drive 61 by a crank 67. FIG. 4 shows a vertical section through crank drive 61. Crank drive 61 includes a crank disk 64 which is provided with a front serration 65 and is rotatably seated on a shaft 62 secured to the frame.

Crank disk 64 is rotated clockwise by a motor, not shown here. A pin 66, permanently attached to crank disk 64, extends into a guide 68 of crank 67, and moves crank 67 vertically up and down with a stoke C. In the illustrated example, the cutting motion of blades 2 and 6 (6') is effected downward, but could also be effected upward. This would require that the respective counter-blades be moved to the opposite side of conveying plane 74. The stroke motion is transmitted to yoke 69 and, finally, to blades 2 and 6 (6'). As mentioned above, the blades 6 and 6' are exchangeably secured to yoke 69 via carriers 75.

In the cutting machine 1 shown in FIG. 3, blades 6' are longer than the blades 6 in FIG. 2. Accordingly, in FIG. 3 the spacing between the two stops 40 and 41 is larger than the corresponding spacing in FIG. 2. In FIG. 2, for example, this spacing is about 305 mm, whereas it is 355 mm in FIG. 3. Of course, the length of the blades 6 and 6' is selected such that the tops and bottoms of the corresponding printed products 21 or 21' can be trimmed without interfering with each other. The correspondingly-longer blade 6' corresponds to the longer printed product 21'. An embodiment in which the blade 6 or 6' is secured to the yoke 69 so as to be horizontally displaced is also conceivable.

Figure 6:
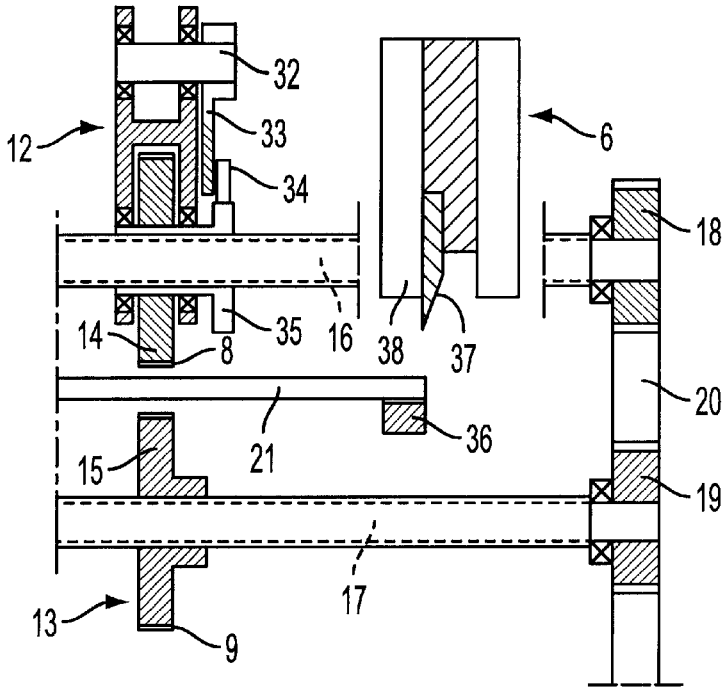
FIG. 6 shows a section along the line VI—VI in FIG. 2.

Blade 2 has a blade element 4 and blades 6 (6') each have a blade element 37 as shown in FIG. 6. Blade element 4 has a counter-blade 72 and blades 6 or 6' each have a counter-blade 36. The counter-blades are provided on machine frame 71. In the illustrated embodiment, first the front is trimmed. Also conceivable, however, is an embodiment in which the top and bottom are trimmed first and the front is trimmed in the second cutting station. In any event, a center cut, for so-called double copies, is also possible.

Figure 5:
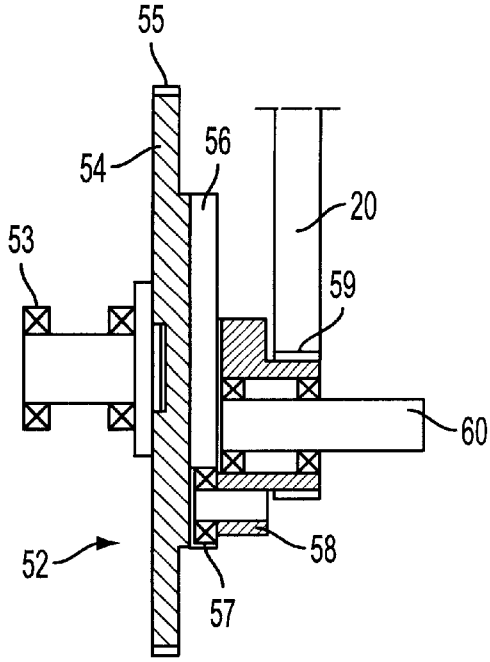
FIG. 5 shows a section along the line V—V in FIG. 3.

Referring now to FIGS. 3, 5 and 6, the drive of belts 8 and 9 of the transport device 7 is effected by a slider crank 52, which is connected by a toothed belt 20 to drive wheels 18 and 19 of the belt drives 12 and 13. Slider crank 52 has a toothed disk 54, which has a surface serration 55 and is rotatably seated, with a bearing, on the frame. The toothed disk 54 meshes with crank disk 64 and is driven thereby.

Toothed disk 54 has a linear guide 56, in which a roller 57 of a wheel 58 is displaceably guided. Wheel 58 rotates on a shaft 60 secured to the frame, and has a toothing 59 that engages the toothed belt 20. The eccentricity and the crank throw of rotating slider crank 52 are constant. Slider crank 52 accelerates and delays belts 8 and 9 in a suitable manner for further transporting products 21 or 21'. Toothed belt 20 drives shafts 16 and 17 via toothed disks 18 and 19 shown in FIG. 6. To change the format range, drive rollers 14 and 15 are exchangeable. Rollers 14 and 15 are smaller in FIG. 2 than those in FIG. 3. Accordingly, the transport path in FIG. 3 is larger.

For controlling the transport of printed products 21, drive 12 for upper belt 8 can be raised from printed products 21 with a predetermined, fixed stroke. To this end, there is provided a lifting device 24 which includes a parallel rod assembly 25. Parallel rod assembly 25 is actuated by a cam 35 which is secured to shaft 16 in accordance with FIGS. 2 and 6. A cam roller 34 rests against cam 35 and actuates a lever 33 which is connected to parallel rod assembly 25 by a bearing 32 secured to the frame and a further lever 33*a* connected at one end to bearing 32 and connected at its other end to slide rod 31 via a further bearing 32*a*. Rod assembly 25 is moved back and forth in the directions of two-headed arrow 30, and correspondingly moves a carrier 22, on which upper belt 8 is seated, in the vertical direction by way of joints 28 and 29, which are secured to the frame. Upper belt 8 is raised shortly before impact of the printed products with the rear stops, which forces the termination of the transport of printed products 21. The printed products 21 are oriented at stops 40 and 41 in a known manner by the upward lifting of transport device 7.

Referring to FIG. 3, rear stops 40 and 41 are secured to be individually adjustable on a carrier 42 which can be moved vertically up and down. Here the corresponding lift is effected by a parallel rod assembly 43, which has two joints 46 that are secured to the frame, and a connecting rod 47. The parallel rod assembly 43 is connected to carrier 42 by two spaced joints 45. Rod 47 can be moved horizontally back and forth in the directions of the two-headed arrow 44 with a two-armed lever 48. Two-armed lever 48 is seated on a joint 49 secured to the frame, and is hinged to parallel rod assembly 43 by a rod 50. The two-armed lever 48 is pivoted about the joint 49 by a roller 51, which rests against a cam 73. Rotating slider crank 52 thus pivots the two-armed lever 48 with a certain stroke, correspondingly lifting the two rear stops 40 and 41 vertically.

FIGS. 2 and 3 show stops 40 and 41 in the upper position, in which the printed products 21 or 21' rest against these stops 40 and 41, respectively. For further transport, stops 40 and 41 are moved downward. Other drives can also perform this lifting motion. The horizontal displacement of stops 40 and 41 and the corresponding change in the cutting region are critical for changing the spacing.

To convert from one format to the other, the distance between stops 40 and 41 is adapted. Moreover, drive rollers 14 and 15 are exchanged for changing the conveying for transporting the printed products 21 or 21'. In addition, different length blades 6 or 6' are installed as appropriate. The other aforementioned functions need not be changed. Examples include, in particular, the stroke of the blades 6 or 6', the rotation of the slider crank 52, the lifting of the upper belt 8 and the lifting of the stops 40 and 41. The blade stroke and the stop stroke are therefore constant, regardless of the format range. The eccentricity and crank throw of the rotating slider crank 52 are likewise constant.

For unlimited alternating of the cutting machine, it is practical to be able to adjust the spacing of the blade carriers 75 from the blade 2 for trimming the front.

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A cutting machine for automatically trimming printed products having a spine and transported spine first along a horizontal path in a transport direction, comprising:

first and second cutting stations spaced from one another along the horizontal path in the transport direction, each station including at least one clamping bar for pressing against the printed product during a trimming operation; and transport means for transporting the printed products spine first along a conveying path from the first cutting station to the second cutting station;

said first cutting station having a reciprocating blade extending transverse to the conveyor path for cutting a front of the printed product, said second cutting station having a two reciprocating blades extending parallel to the conveyor path for cutting a top and a bottom of the printed product, the reciprocating blades of the cutting station being controlled to cut simultaneously; and wherein both cutting stations each comprise an adjustable stop associated with the respective cutting station, and disposed along the conveying path for the printed products being transported spine first, both of the adjustable stops being adjustable along the conveying path for adjusting a length of the conveying path formed by a spacing between the stops and for adjusting a cutting region for top and bottom trimming of the printed products along the conveying path.

2. The cutting machine as defined in claim 1, wherein one of the first and second stations includes two blades disposed opposite one another along the conveying path for top and bottom trimming, said two blades being removeably mounted for exchange with blades of a different length.

3. The cutting machine as defined in claim 2, wherein the two blades for top and bottom trimming are displaceable along the conveying path of the printed products.

4. The cutting machine as defined in claim 3, further comprising two blade carriers mounting, respectively, the two blades for top and bottom trimming, the two blade carriers being adjustable in the transport direction along the conveying path for adjusting a spacing of the two blades from the blade that trims the front of the printed products.

5. The cutting machine as defined in one of claim 1, wherein the spacing between the stops can be adjusted from a minimum to a maximum format width of the printed products.

6. The cutting machine as defined in claim 1, wherein the conveying path traversed by the transport means between the stations is larger than a spacing between the stops.

7. The cutting machine as defined of claim 1, wherein the transport means includes a drive comprised of circulating belts and exchangeable drive rollers for driving the belts for adaptation to the spacing between the cutting stations.

8. The cutting machine as defined in claim 7, wherein the circulating belts include upper and lower belts each of which is driven by a respective one of the exchangeable drive rollers.

9. A cutting machine for automatically trimming printed products having a spine and transported spine first along a horizontal path in a transport direction, comprising:

first and second cutting stations spaced from one another along the horizontal path in the transport direction, each station including at least one clamping bar for pressing against the printed product during a trimming operation;

said first cutting station having a reciprocating blade extending transverse to the conveyor path for cutting a front of the printed product, said second cutting station having a two reciprocating blades extending parallel to the conveyor path for cutting a top and a bottom of the printed product, the reciprocating blades of the cutting station being controlled to cut simultaneously; and transport means for transporting the printed products along a conveying path from the first cutting station to the second cutting station;

adjustable stops associated with the cutting stations, and disposed along the conveying path for the printed products, the adjustable stops associated with both cutting stations being adjustable along the conveying path for adjusting a spacing between the stops and for adjusting a cutting region for top and bottom trimming of the printed products along the conveying path;

a rotating slider crank operatively connected for driving the transport means; and a crank drive for controlling a stroke of the blades operatively connected to the rotating slide crank.

10. The cutting machine as defined in claim 9, wherein the slider crank accelerates and delays the upper and lower belts.

11. The cutting machine as defined in claim 10, wherein exchangeable drive roller for the upper belt includes a drive shaft, and further comprising a cam disposed on said drive shaft and co-rotating therewith and operatively arranged for the lifting of the upper belt.

* * * * *